US006319044B1

(12) United States Patent
Stekelenburg

(10) Patent No.: US 6,319,044 B1
(45) Date of Patent: Nov. 20, 2001

(54) CORD LOCK

(75) Inventor: Albert Stekelenburg, Taipei (TW)

(73) Assignee: All-Line Inc., Taipei (TW)

( * ) Notice: Subject to any disclaimer, the term of this patent is extended or adjusted under 35 U.S.C. 154(b) by 0 days.

(21) Appl. No.: 09/559,583

(22) Filed: Apr. 28, 2000

(51) Int. Cl.[7] ..... H01R 13/62
(52) U.S. Cl. ..... 439/369; 439/371
(58) Field of Search ..... 439/369, 371

(56) References Cited

U.S. PATENT DOCUMENTS 5,104,335 * 4/1992 Conley et al. ..... 439/369
5,129,839 * 7/1992 VanSkiver ..... 439/367
5,167,524 * 12/1992 Falcon et al. ..... 439/371
5,582,524 12/1996 Sanner et al. ..... 439/369

* cited by examiner

*Primary Examiner*—Gary Paumen
*Assistant Examiner*—Ann McCamey
(74) *Attorney, Agent, or Firm*—Dougherty & Troxell

(57) ABSTRACT

A cord lock for locking together a male plug and a female plug including a clamping body and a sleeving body. The male plug and the female plug are placed in the clamping body, with the wires of the male plug and female plug, respectively, placed in recesses in the clamping body and the sleeving body. The connected male plug and the female plug are locked in a stable state by projections provided on a movable plate body on both sides of the sleeving body, which are inserted in holes on clamping arms of the clamping body.

1 Claim, 2 Drawing Sheets

CORD LOCK

FIELD OF THE INVENTION

This invention relates to a device for preventing separation of two connected electrical cords and, more specifically, to an electrical cord lock which holds two interconnecting electrical plugs together in a stable state.

BACKGROUND OF THE INVENTION

Power tools and other portable electrical equipment are generally equipped with a relatively short electrical power cord having a male plug at the end thereof. However, a longer power cord is often required to provide power to the tools in an area remotely located from an electrical outlet. As a result, power tools are frequently connected to remote outlets via extension cords. An extension cord is an electric cord fitted with a male plug at one end and a female receptacle at the other end. The female receptacle end of the extension cord is mated with the male plug of the power tool cord. The male plug of the extension cord is inserted into a conventional outlet, providing an electrical connection between the outlet and the power tool. Additionally, numerous extension cords may be connected together, extending the distance of the electrical connection between power tools and remote outlets.

Electrical cords maintain a plugged together relationship between prongs of the male plug and corresponding receptacles of the female plug through friction. The friction between the plugs is adequate to maintain the electrical cords in a plugged together relationship when the cords are stationary. However, the friction between plugs may be insufficient to hold the electrical cords together when the cords are moved around, such as at a construction site. In the latter situation, the insufficient friction between the plugs causes them to accidentally separate, interrupting the flow of electricity to the power tool. The interruption of the flow of electricity to the tool can be annoying and time consuming, and sometimes possibly dangerous in certain situations.

Therefore, there are severl types of cord lock which are applied, such as U.S. Pat. No. 5,582,524 as shown in FIG. 1 which is a perspective view of an embodiment for an invention, wherein there are two eyelet members provided on a base member, and two planar brims provided between two eyelet members, the electrical cord behind male plug and female plug is made in the shape of looped portion which is extended from the eyelet members and is sleeved on the planar brims, the pulling force behind the electrical cord is not easily transmitted to the male plug and female plug by use of stretching the electrical cord in hook members of planar brims, so that the connection of male plug and female plug can not be separated by the pulling force; the above-mentioned structure is not so ideal, because the electrical cord must be more than twice folded.

In male plug or female plug having electrical cord, the connection between its plug body and electrical cord is very tight (it's even then integrated), the connecting position is not easily broken, what is more, the head bodies of male plug and female plug are large than the diameter of electrical cord.

SUMMARY OF THE INVENTION

The object of the present invention is to provide a cord lock, i.e. to provide a clamping body and a sleeving body, two head bodies of male plug and female plug which are connected together can be clamped between the clamping body and the sleeving body.

The clamping body and the sleeving body can be integrated by clamping, the pulling force for separating male plug and female plug is transmitted to the clamping body and the sleeving body.

There are recesses provided on the clamping body and sleeving body, the electrical cord is placed therein.

The male plug and female plug are in a preset position where is between the clamping body and the sleeving body.

There are several positions fixed by the sleeving body, provided on the clamping body, the space between the clamping body and the sleeving body can be adapted to the connected body of male plug and female plug which have multiple different dimensions.

The cord lock provided by the present invention can provide a state in which the occupied space is less than conventional and using is easier.

Another object of this invention is to provide a device for holding the connection between male and female plugs and which can be manufactured easily and at a low cost from commercially available materials.

DETAILED DESCRIPTION OF THE INVENTION

Figure 1:
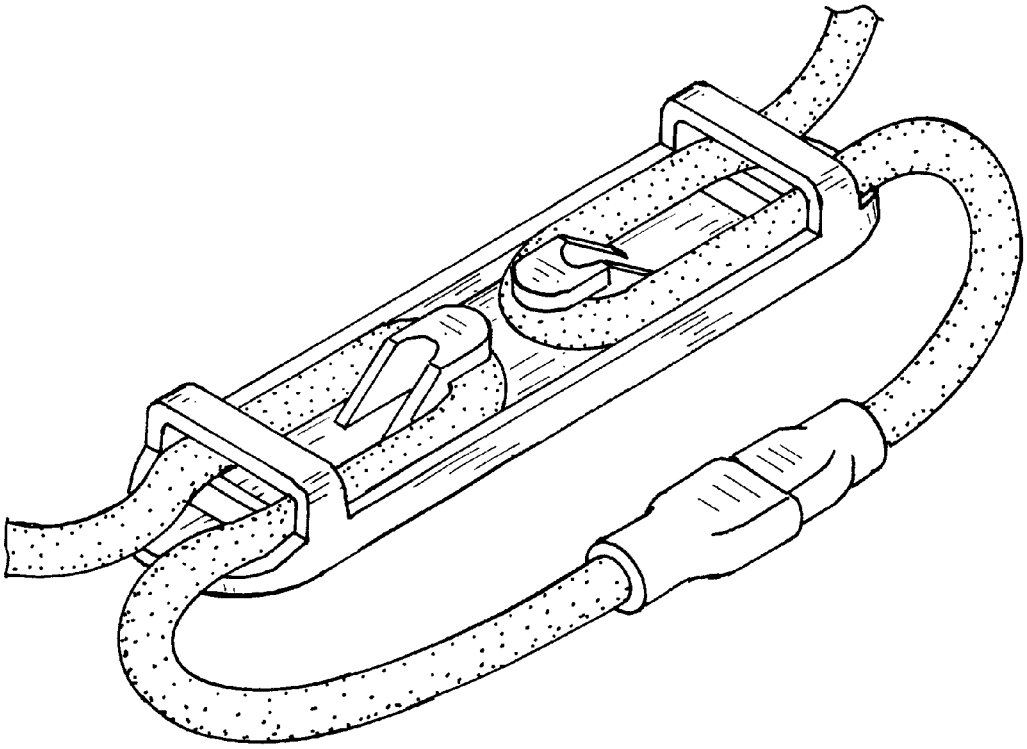
FIG. 1 (PRIOR ART)
FIG. 1 is a perspective view of a prior art cord lock.
Figure 2:
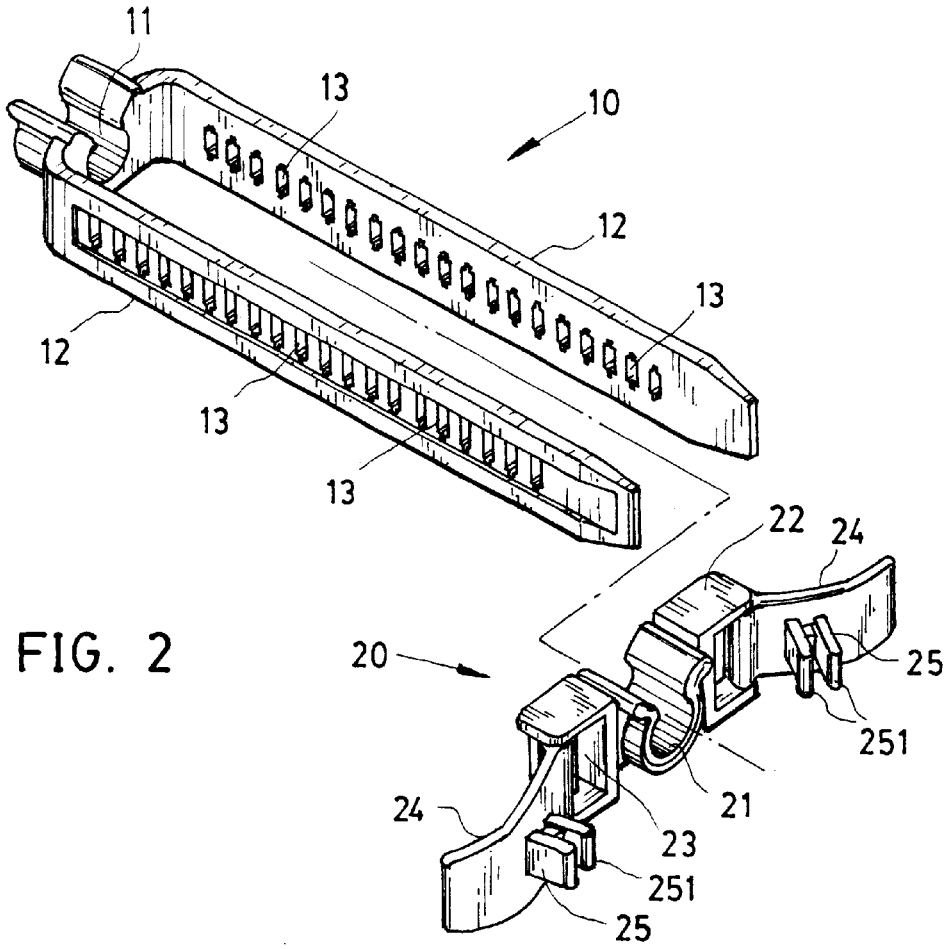
FIG. 2 is a perspective exploded view of cord lock of the present invention, installed with a connected male and female plugs, and associated cord.

Referring to FIG. 2, the constitution of the present invention includes mainly a clamping body 10 and a sleeving body 20; the sleeving body 20 can be sleeved in the clamping body 10.

Figure 3:
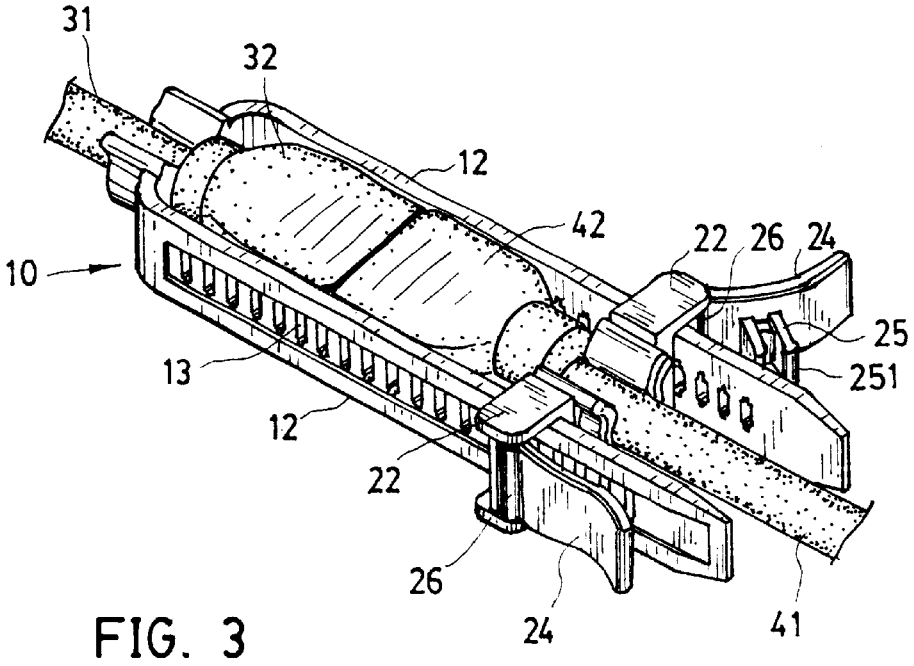
FIG. 3 is a perspective view of an embodiment for the present invention, which include providing a male plug and a female plug.

As shown in FIG. 3, its fronts for a pair of wires 31–41 connect respectivey a male plug 32 and a female plug 42, after the male plug 32 and the female plug 42 are integrated, the sleeving body 20 is placed and clamped to the clamping body 10.

The constitution of the clamping body 10 includes a recess 11 and two side clamping arms 12, there are several holes 13 provided on the clamping arms 12, the width between two side clamping arms 12 is slight larger than the width (or highness) of male plug 32 or female plug 42.

The constitution of the sleeving body 20 includes a recess 21 left-right side wings 22 (each has one), there is a hole 23 provided on the each side wing 22, there is a movable plate body 24 provided on the external side of the side wings 22 and the hole 23, there is a projection 25 provided on the inner side of the plate body 24.

The recesses 11–21 are open-top recess body, its direction is parallel to the connecting direction of the clamping body 10 and sleeving body 20 (or positioned in the center line), the wires 31–41 can be clamped therein, but the male plug 32 or the female plug 42 can not be passed (i.e. the diameter of the recesses 11–21 is larger than the diameter of the cord, but is less than the male plug 32 and female plug 42), the state as shown in FIG. 3, the male plug 32 and the female plug 42 can not back from the recesses 11–12; in other words, the male plug 32 and the female plug 42 can not back when the male plug 32 or the female plug 42 are placed in the two clamping arms 12, and the wires 31–41 are placed in the recesses 11–21.

The hole 23 provided on the side wings 22 is matching the width of two clamping arms 12 and the highness of the clamping arm 12, the clamping arms 12 can be inserted in the sleeving body 20; there is a movable plate body 24 provided on each external side of two side wings 22, there is a projection 25 provided to the inner side of the movable plate body 24, the projection 25 has two projective teeth 251, the projective teeth 251 can be inserted (or drawn out) in the hole 13 by means of applying a force to the plate body 24; one end of the plate body 24 is provided in the external edge of the side wings 22 by means of a structure which is in the form of rotating 26.

The sleeving body 20 is sleeved in the clamping body 10, when the male plug 32 and female plug 42 is connected and the wires 31–41 are placed in the recesses 11–21, the male plug 32 and the female plug 42 are then clamped, the projective teeth 251 is came into the hole 13 by pushing the plate body 24, i.e. the male plug 32, female plug 42 and wires 31–41 are in the clamping body 10 and the sleeving body 20 and the state is quite stable.

While particular elements, embodiments and applications of the present invention have been shown and described, it will be understood. of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A cord lock for locking male and female electrical plugs attached to electrical cords in a connected state and comprising:

a) a clamping body having a base portion with a first open topped recess therein sized so as to accept an electrical cord therein and prevent passage therethrough of the male and female electrical plugs, and a pair of spaced apart side clamping arms extending from the base portion, each clamping arm having a plurality of holes therein, the spacing between the side clamping arms sized so as to accept the male and female electrical plugs therebetween; and, b) a sleeving body removably engageable with the clamping body, the sleeving body having a second open topped recess sized so as to accept an electrical cord therein and prevent passage therethrough of the male and female electrical plugs; a pair of side wings, each side wing having an opening to accept passage of one of the pair of side clamping arms therethrough, each side wing having a movable plate body pivotally attached thereto, each movable plate body having at least one projecting tooth engageable with at least one of the plurality of holes in the side clamping arms to thereby removably attach the sleeving body to the clamping body, to thereby clamp male and female electrical plugs between the clamping body and the sleeving body.

* * * * *